US008241153B2

(12) United States Patent
Williams

(10) Patent No.: US 8,241,153 B2
(45) Date of Patent: Aug. 14, 2012

(54) SPORTS ACTIVITY DEVICE

(75) Inventor: Kevin Williams, Sprakers, NY (US)

(73) Assignee: OgoSport, LLC, Brooklyn, NY (US)

( * ) Notice: Subject to any disclaimer, the term of this patent is extended or adjusted under 35 U.S.C. 154(b) by 137 days.

(21) Appl. No.: 12/629,586

(22) Filed: Dec. 2, 2009

(65) Prior Publication Data

US 2011/0130229 A1 Jun. 2, 2011

(51) Int. Cl.
*A63B 65/12* (2006.01)
*A63B 59/02* (2006.01)

(52) U.S. Cl. ..... 473/505; 473/588; 473/528; 446/46; D21/443; 273/317

(58) Field of Classification Search ..... 473/505, 473/590, 588; D21/437, 443; 446/46, 47, 446/153; 441/80; 182/230; 720/718
See application file for complete search history.

(56) References Cited

U.S. PATENT DOCUMENTS

| | | | | | |
|---|---|---|---|---|---|
| 1,056,966 | A | * | 3/1913 | Belding | 38/102.2 |
| 1,221,123 | A | * | 4/1917 | Westhaver | 38/102.2 |
| 3,948,523 | A | * | 4/1976 | Michael | 473/588 |
| 4,080,753 | A | * | 3/1978 | Hiner et al. | 446/47 |
| 4,112,131 | A | * | 9/1978 | Bosy et al. | 426/582 |
| 4,173,839 | A | * | 11/1979 | Kovac | 446/46 |
| 4,212,131 | A | * | 7/1980 | Ross, Jr. | 446/48 |
| 4,351,129 | A | * | 9/1982 | Kerkenbush et al. | 446/46 |
| 4,503,635 | A | | 3/1985 | Harrington | |
| 4,709,928 | A | | 12/1987 | Willingham | |
| 4,889,347 | A | * | 12/1989 | Mineart | 473/588 |
| 4,940,441 | A | * | 7/1990 | Novinsky | 446/46 |
| 5,261,846 | A | | 11/1993 | Hanna | |
| 5,358,440 | A | * | 10/1994 | Zheng | 446/48 |
| 5,366,403 | A | * | 11/1994 | Weiss | 446/46 |
| 5,575,479 | A | * | 11/1996 | Ayres | 273/378 |
| 5,579,296 | A | * | 11/1996 | Smith et al. | 369/273 |
| 6,113,453 | A | * | 9/2000 | Stuffelbeam | 446/46 |
| 6,527,608 | B2 | * | 3/2003 | Calco | 446/48 |
| 6,544,093 | B2 | | 4/2003 | Komuro | |
| 6,682,384 | B2 | | 1/2004 | Wang | |
| 6,756,521 | B1 | | 6/2004 | Breitkopf | |
| 6,860,783 | B1 | * | 3/2005 | Kucha et al. | 446/46 |
| 6,908,359 | B2 | | 6/2005 | Orlowski | |
| 6,939,191 | B1 | | 9/2005 | Wu | |
| 7,007,290 | B2 | * | 2/2006 | Wilcoxson et al. | 720/718 |
| 7,198,536 | B2 | | 4/2007 | Nuccio et al. | |
| 2005/0092258 | A1 | * | 5/2005 | Markham | 119/707 |
| 2006/0073758 | A1 | | 4/2006 | Goodwin et al. | |

* cited by examiner

*Primary Examiner* — Gene Kim
*Assistant Examiner* — M Chambers
(74) *Attorney, Agent, or Firm* — Kane Kessler, P.C.; Barry E. Negrin

(57) ABSTRACT

A sports activity device playable, for example, as a device for launching and catching objects and as a tossable flying disc. Embodiments of the sports activity device includes an outer annular ring member and an inner annular ring assembly detachably engaged to the outer annular ring member. The inner annular ring assembly may include an inner annular ring member and an engagement assembly configured and operable to facilitate detachable engagement of the inner annular ring assembly with the outer annular ring member.

12 Claims, 5 Drawing Sheets

SPORTS ACTIVITY DEVICE

FIELD OF THE INVENTION

The present invention relates generally to sports activity devices, and more particularly, to a sports activity device that may be used as a tossable flying disc or as a device for launching or catching an object.

BACKGROUND

Flying discs and the like have long been known in the art, as have variations on the basic premise, including discs that glow in the dark or discs having a hole in the middle thereof to allow for the disc to be thrown further.

An example of a glow-in-the-dark flying disc is shown in U.S. Pat. No. 6,544,093 to Komuro for a "Revolving and flying toy," which discloses a revolving and flying toy having an insert pocket in which a chemical luminous body may be placed. Similarly, U.S. Pat. No. 5,083,799 to Thill for a "Lightable whistling disc" discloses a tossable disc including a substantially flat, planar section and an inflatable ring and attached thereto with a chemiluminescent light source positioned on the planar section and a plurality of whistle elements mounted on the inflated ring such that as the toy is tossed through the air the movement thereof will present an auditory sound and the chemiluminescent light source may be activated at the user's desire.

There are also references which teach making the flying disc toy flexible so as to be safer to use and easier to catch. For example, U.S. Pat. No. 4,290,226, to Stauffer for a "Flexible flying disc toy" discloses a flexible flying disc toy having a flat, flexible body of fabric material, whereby an advertising message or the like may be printed thereon, and a shape defining and retaining, flexible peripheral ring and rim integrally formed of vinyl or the like so that the disc toy may be folded or crumpled for storage, the toy assuming its original shape after storage and before use.

SUMMARY OF THE INVENTION

The invention relates to a sports activity device playable as a device for launching and catching objects and as a tossable flying disc. Embodiments of the sports activity device include an outer annular ring member having a continuous outer surface and a continuous inner surface, and an inner annular ring assembly detachably engaged to the outer annular ring member.

The inner annular ring assembly may include an inner annular ring member having a continuous outer surface and a continuous inner surface. An engagement assembly may be provided on the continuous inner surface of the inner annular ring member configured and operable to facilitate the detachable engagement of the inner annular ring assembly with the outer annular ring member. The inner ring assembly preferably further includes a flexible material creating a substantially uninterrupted planar surface that stretches across an annular cavity defined by the continuous inner surface of the inner ring member configured and operable to launch and/or catch objects, such as balls.

BRIEF DESCRIPTION OF THE DRAWINGS

The objects and features of the invention may be understood with reference to the following detailed description of illustrative embodiments of the present invention taken together in conjunction with the accompanying drawings in which:

FIG. 8 is a detailed cross-sectional view of the inner trampoline assembly of FIG. 5;

DETAILED DESCRIPTION

Figure 4:
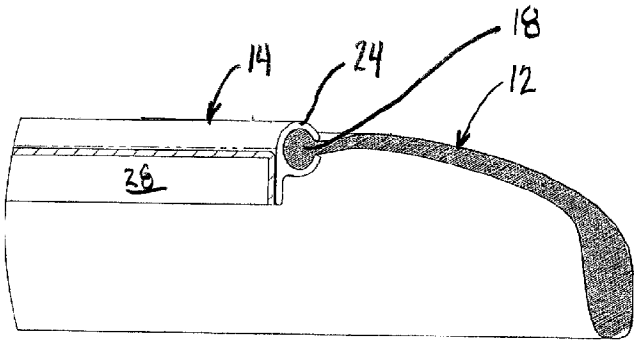
FIG. 4 is a detailed cross-sectional view of the sports activity device of FIG. 1.
Figure 2:
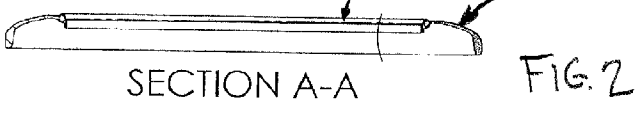
FIG. 2 is a cross-sectional view of the sports activity device of FIG. 1.

The present invention will now be described more fully with reference to the accompanying drawings, in which illustrated embodiments of the present invention are shown and like reference numerals identify similar elements. The present invention is not limited in any way to any of the illustrated embodiments.

With reference now to the drawings, and in particular to FIGS. 1 through 8, a new sports activity device embodying the principles and concepts of an illustrated embodiment of the present invention, and generally designated by reference numeral 10, will now be described.

Figure 3:
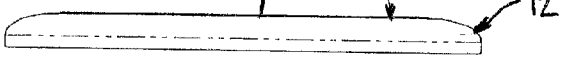
FIG. 3 is a side-planar view of the sports activity device of FIG. 1.
Figure 3:
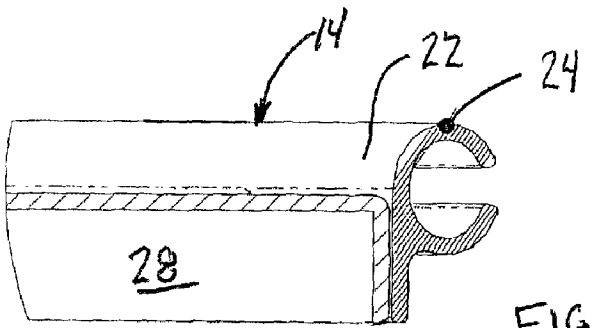

Sports activity device 10 includes an outer ring member 12 detachably engaged with an inner ring assembly 14. Outer ring member 12 may be formed of any material having sufficient composition (e.g, foam, plastic, and the like) which retains its annular shaped (FIG. 1) when used in play activity. In the present illustrated embodiment, the outer ring member 12 has an elliptical side profile (FIG. 3). It is to be appreciated the outer ring member 12 may also be configured in other various side profiled configurations, including, semi-circular, toroidal and the like. Similarly, the shape of the outer ring member 12 is not to be understood to be limited to circular as other shapes are also contemplated in a variety of geometric shapes, such as oval, star-shaped, triangular or rectangular. Certainly some shapes might be better suited to flying than others; however, the sports activity device 10 of the present invention may also be used for other activities as discussed herein.

Figure 1:
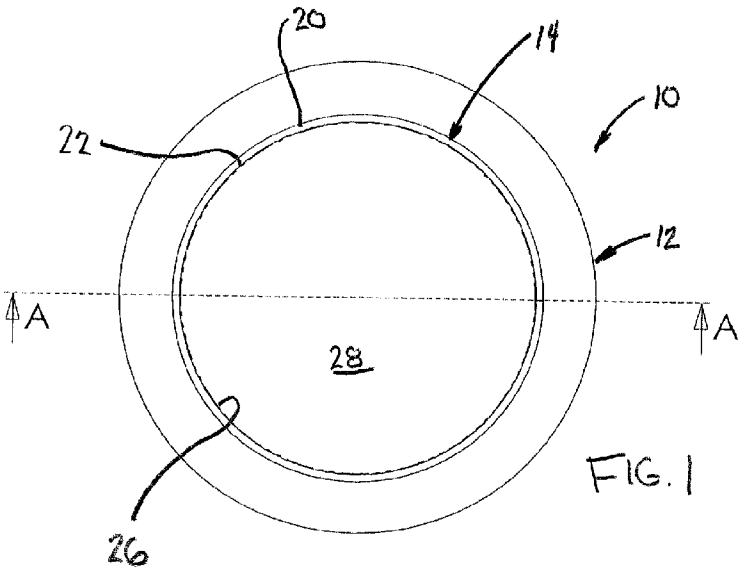
FIG. 1 is a top planar view of the of the sports activity device of the invention.

The outer ring member 12 is formed with an opposing annular distal end 16 and annular proximal end 18. As best shown in FIG. 4, the annular proximal end 18 is formed to have a circular cross-section hereinafter also referred to as a "removable trampoline extrusion receiver." This annular removable trampoline extrusion receiver 18 is configured to detachably engage with a removable trampoline extrusion provided on the inner trampoline ring assembly 14, as to be described below. As best shown in FIG. 1, the outer ring assembly 12 defines an inner circular cavity 20 in which the inner trampoline ring assembly 14 detachably engages therewithin.

With primary reference now to FIGS. 5-8, the inner ring trampoline assembly 14 forms an annular shaped configuration in conformity with that of the inner circular cavity 20 of the outer ring assembly 12 so as to detachably engage therewith, as described below. The inner ring trampoline assembly 14 includes an annular ring member 22 having an outer annular end portion 24 defining a circular cross-sectional cavity (also know as the "removable trampoline extrusion member") configured to detachably receive the annular removable trampoline extrusion receiver 18 of the aforesaid outer ring member 12. As best shown in FIG. 4, the removable trampoline extrusion member 24 is slotted to receive the annular removable trampoline extrusion receiver 18 of the aforesaid outer ring member 12.

Figure 5:
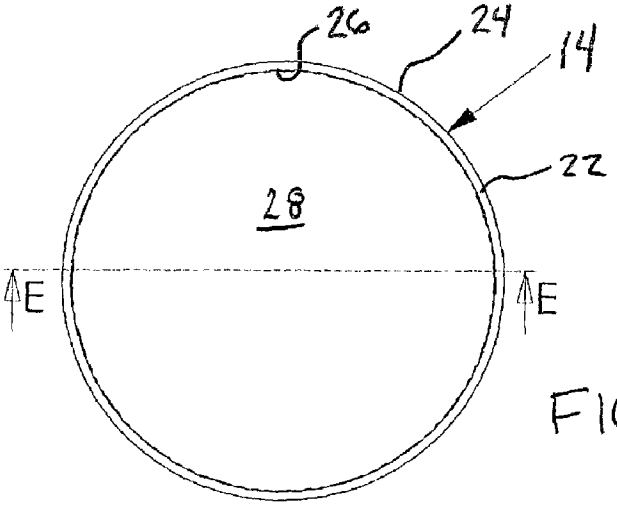
FIG. 5 is a top planar view of an inner trampoline assembly of the sports activity device of FIG. 1.
Figure 6:
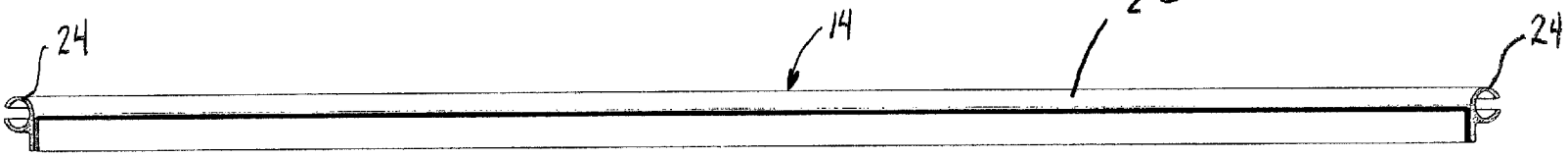
FIG. 6 is an inner partial side view the inner trampoline assembly of FIG. 5.
Figure 7:
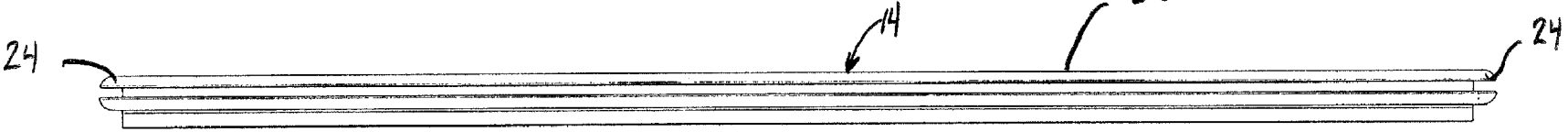
FIG. 7 is an outer side view of the inner trampoline assembly of FIG. 5.

As best shown in FIG. 5, the inner ring assembly 14 defines an inner circular cavity 26 in which extends a flexible web like material 28. Preferably, the flexible web material 28 is fabricated of an elastic material that creates a substantially uninterrupted, trampoline-like, planar surface that stretches across the inner circular cavity 26 of the inner ring assembly 14. The flexible web like material 28 is adhered to the annular ring member 22 through any known appropriate affixation means including, sewing, gluing, staples, welding, stakes and the like. This trampoline surface 28 can be formed using a variety of elastic materials that serve the purpose of allowing the user to both catch or rebound an object, and also assisting in the flight of the sports activity device 10.

With reference to FIGS. 1-4, the sports activity device 10 of the present illustrated embodiment is shown having its aforesaid outer ring member 12 detachably engaged with its inner ring assembly 14. It is noted that when a load is applied perpendicular to the trampoline surface 28 (e.g., when a ball strikes it), the removable trampoline extrusion member 24 is configured to rotate about the removable trampoline extrusion receiver 18 of the aforesaid outer ring member 12, as opposed to tending to slide off and separate from the annular the removable trampoline extrusion member 24.

Referring to FIGS. 9-13, another illustrated embodiment of the sports activity device, designated generally by reference numeral 100, will now be discussed. Sports activity device 100 is similar to the above described sports activity device 10 which includes an outer ring member 112 preferably affixed to an inner ring assembly 14, which inner ring assembly 14 is to be understood to be the same as described above with reference to the above described sports activity device 10.

Figure 12:
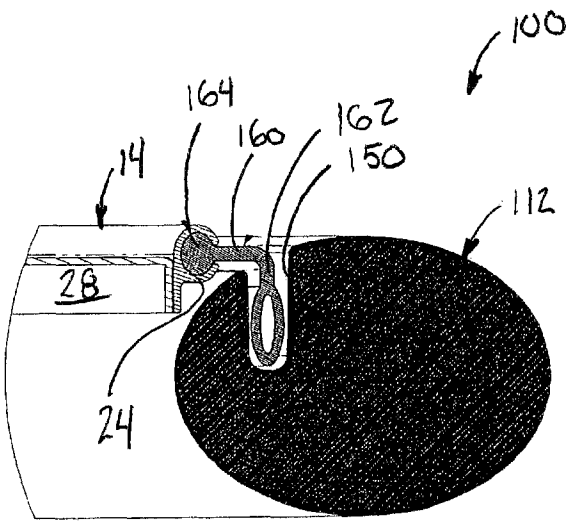
FIG. 12 is a detailed cross-sectional view of the sports activity device of FIG. 9.
Figure 10:
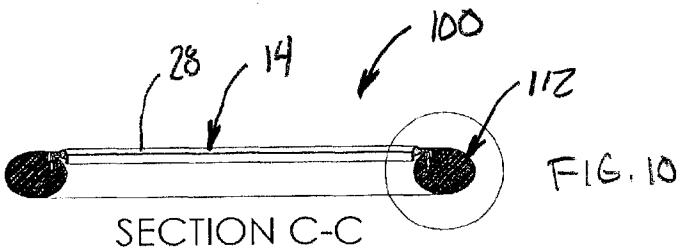
FIG. 10 is a cross-sectional view of the sports activity device of FIG. 9.
Figure 9:
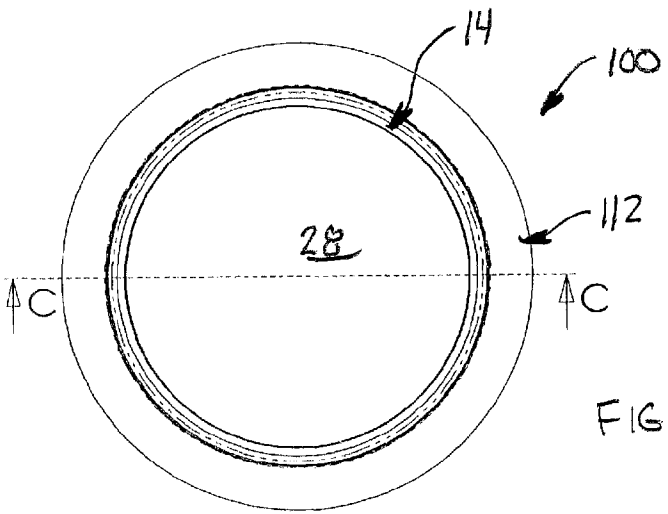
FIG. 9 is a top planar view of the sports activity device in accordance with another illustrated embodiment of the invention.
Figure 11:
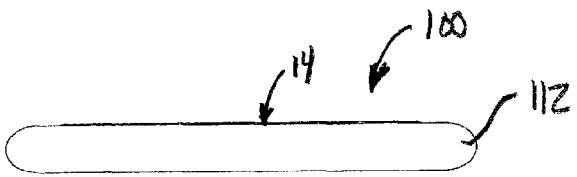
FIG. 11 is a side-planar view of the sports activity device of FIG. 9.
Figure 16:
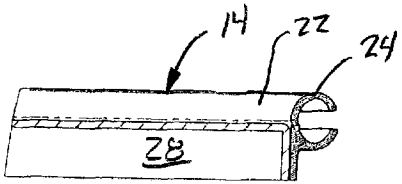
FIG. 16 is a detailed cross-sectional view of the inner trampoline assembly of FIG. 13.
Figure 14:
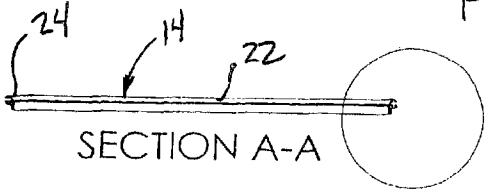
FIG. 14 is an inner partial side view the inner trampoline assembly of FIG. 13.
Figure 13:
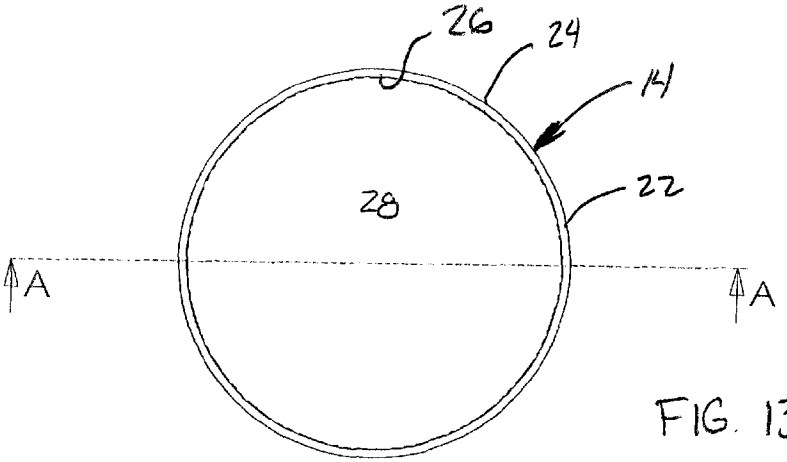
FIG. 13 is a top planar view of an inner trampoline assembly of the sports activity device of FIG. 9.
Figure 15:
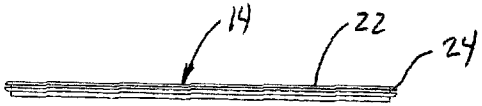
FIG. 15 is an outer side view of the inner trampoline assembly of FIG. 13.

The outer ring member 112 of sports activity device 100 is preferably formed of a foam like material forming a circular configuration. In this illustrated embodiment, the outer ring member 112 has a semi-circular side profile (FIG. 11). An annular channel 150 is defined along the surface of the outer ring member 112 as shown in FIG. 12.

Sports activity device 100 of this illustrated embodiment includes a separate trampoline extrusion member 160 having a first end 162 affixed within the annular channel 150 of the outer ring member 112 preferably using any known affixation means, such as glue. A second opposing end 164, preferably orientated at a 90 degree angle relative to the first end 162, is configured to detachably engage with the removable trampoline extrusion 24 provided on the inner trampoline ring assembly 14, as described above. Thus, like sports activity device 10, the inner ring assembly 14 of sports activity device 100 detachably engages with its aforesaid outer ring member 112.

Having thus described the invention with particular reference to illustrated embodiments hereof, it is to be appreciated that various changes and modifications can be made therein without departing from the spirit and scope of the present invention as defined by the appended claims. For example, the elastic planar surface 28 can additionally serve a promotional or advertising purpose by allowing for graphic branding or imprinting. Additionally a more heavy-duty elastic membrane may be used for the planar surface 28, thereby allowing it to be used as an athletic training aid. Used in conjunction with an exercise "heavy ball", the invention would aid in organized training sessions geared towards building core strength and coordination across ages ranging from child to senior.

Furthermore, the aforesaid sports activity device 10 of the invention can be made in a variety of sizes and materials that would extend the occasions and environments in which it can be used. For example, smaller softer versions may be used indoors with softer and lighter balls or objects. Larger, more rigid versions may be provided which would require greater strength and would rebound balls and other objects to greater distances and velocities. Heavy-duty versions that would utilize cover materials for the elastic planar surface 28 having textures and reliefs allowing for more positive handgrip and resistance to abrasion.

It is further to be appreciated that the aforesaid sports activity device lends itself to a variety of play/athletic uses. Examples of such uses include:

- Two or more participants can catch and rebound a ball or other object in a back and forth manner that allows them to increase the velocity, height, and distance of the object.
- One person can receive and rebound a ball or other object in an up and down manner increasing the velocity and height of the object. They may also use a variety of vertical surfaces as a target against which to bounce a resilient ball or other object.
- Two or more participants may engage in receiving and rebounding an object and include the throwing of the device in a "Frisbee" like manner at the same time in order to provide a more multi-skilled sport.
- The sports activity device may be used to participate in a variety of existing athletic sports such as, but not limited to:
  - Tennis
  - Badminton
  - Volleyball
  - Basketball
  - Baseball/softball
  - Soccer
  - Handball
  - Squash
  - Racquetball
  - Table tennis
  - Football
- The aforesaid sporting device can be set in a fixed position and used as a target for throwing and rebounding of balls and other objects.

What is claimed is:

1. A sports activity device, adapted to be both a flying disc and a racquet-like apparatus, comprising:

an outer annular ring member having a continuous outer surface and a continuous inner surface; and an inner annular ring assembly detachably engaged to said outer annular ring member, said inner annular ring assembly including:

an inner annular ring member having a continuous outer surface and a continuous inner surface;

an engagement assembly provided on said continuous outer surface of said inner annular ring member configured and operable to facilitate said detachable engagement of said inner annular ring assembly with said outer annular ring member; and a flexible material creating a substantially uninterrupted planar trampoline surface that stretches across an annular cavity defined by said continuous inner surface of said inner ring member, wherein said flexible material is attached to said continuous inner surface of said inner ring member;

wherein said engagement assembly includes said inner ring member to have a cross-section forming a substantially cross-sectionally symmetrical open cavity along its continuous outer surface configured and operable to detachably engage with a portion of said continuous inner surface of said outer annular ring member but to not separate when a load is applied substantially perpendicular to said planar trampoline surface so as to enable the user to launch or receive objects as a racquet-like apparatus.

2. A sports activity device as recited in claim 1, wherein said continuous inner surface of said outer annular ring member is formed with an annular cross-section configured to detachably engage with said open cavity of said inner ring member.

3. A sports activity device as recited in claim 2, wherein each said cross section of said continuous inner surface of said outer annular ring member and said continuous outer surface of said inner ring member is circular shaped.

4. A sports activity device as recited in claim 1, wherein said engagement assembly is operable such that when an object is caused to strike said flexible material said continuous inner surface of said outer annular ring member is caused to rotate about said continuous outer surface of said inner ring member.

5. A sports activity device, adapted to be both a flying disc and a racquet-like apparatus, comprising:

an outer annular ring member having a continuous outer surface and a continuous inner surface;

an inner annular ring assembly including an inner ring member having a continuous outer surface and a continuous inner surface, said continuous outer surface of said inner ring member having a cross-section forming a substantially cross-sectionally symmetrical open cavity, said inner ring assembly further including a flexible material, attached to said continuous inner surface of said inner ring member, creating a substantially uninterrupted planar trampoline surface that stretches across an annular cavity defined by said continuous inner surface of said inner ring member; and an engagement member affixed to said continuous inner surface of said outer annular ring member having an engagement projection extending inwardly from said continuous inner surface of said outer annular ring member configured and operable to detachably engage with said open cavity of said continuous outer surface of said inner annular ring member but to not separate when a load is applied substantially perpendicular to said planar trampoline surface so as to enable the user to launch or receive objects as a racquet-like apparatus.

6. A sports activity device as recited in claim 5, wherein said engagement projection of said engagement member is formed with an annular cross-section configured to detachably engage with said open cavity of said inner ring member.

7. A sports activity device as recited in claim 6 wherein each said cross section of said engagement projection of said engagement member and said continuous outer surface of said inner ring member is circular shaped.

8. A sports activity device as recited in claim 5, wherein said continuous inner surface of said outer annular ring member is provided with a channel wherein at least of portion of said engagement member is affixed therewithin.

9. A sports activity device as recited in claim 5, wherein said outer annual ring member is formed of foam material.

10. A sports activity device, adapted to be both a flying disc and a racquet-like apparatus, comprising:

an outer annular ring member having a continuous outer surface and a continuous inner surface; and an inner annular ring assembly detachably engaged to said outer annular ring member, said inner annular ring assembly including:

an inner annular ring member having a continuous outer surface and a continuous inner surface with said continuous inner surface defining an annular cavity an engagement assembly provided on said continuous outer surface of said inner annular ring member configured and operable to facilitate said detachable engagement of said inner annular ring assembly with said outer annular ring member, said engagement assembly including said inner ring member to have a cross-section forming a substantially cross-sectionally symmetrical open cavity along its continuous outer surface configured and operable to detachably engage with said continuous inner surface of said outer annular ring member; and a flexible material creating a substantially uninterrupted planar trampoline surface that stretches across said annular cavity of said inner ring member, said flexible material being attached to said continuous inner surface of said inner ring member, wherein said substantially cross-sectionally symmetrical open cavity does not separate from said continuous inner surface of said outer annular ring member when a load is applied substantially perpendicular to said planar trampoline surface so as to enable the user to launch or receive objects as a racquet-like apparatus.

11. A sports activity device as recited in claim 10, wherein said continuous inner surface of said outer annular ring member is formed with an annular cross-section configured to detachably engage with said open cavity of said inner ring member.

12. A sports activity device as recited in claim 11, wherein said engagement assembly is operable such that when an object is caused to strike said flexible material said continuous inner surface of said outer annular ring member is caused to rotate about said continuous outer surface of said inner ring member.

* * * * *